US012808374B2

(12) United States Patent
Haas et al.

(10) Patent No.: US 12,808,374 B2
(45) Date of Patent: Nov. 24, 2026

(54) TANDEM PUMP COMPRISING A MAIN FLOW AND A DRY SUMP FLOW

(71) Applicant: Schaeffler Technologies AG & Co. KG, Herzogenaurach (DE)

(72) Inventors: Maximilian Haas, Bühl (DE); Marco Grethel, Bühlertal (DE); Felix Bunout, Karlsruhe (DE); Manuel Koch, Karlsruhe (DE); Alexander Neudorf, Karlsruhe (DE)

(73) Assignee: Schaeffler Tech AG & Co. KG, Herzogenaurach (DE)

( * ) Notice: Subject to any disclaimer, the term of this patent is extended or adjusted under 35 U.S.C. 154(b) by 141 days.

(21) Appl. No.: 18/728,202

(22) PCT Filed: Dec. 6, 2022

(86) PCT No.: PCT/DE2022/100912
§ 371 (c)(1),
(2) Date: Jul. 11, 2024

(87) PCT Pub. No.: WO2023/134809
PCT Pub. Date: Jul. 20, 2023

(65) Prior Publication Data

US 2025/0101978 A1 Mar. 27, 2025

(30) Foreign Application Priority Data

Jan. 12, 2022 (DE) ..... 102022100574.7

(51) Int. Cl.
*F04C 11/00* (2006.01)
*F04C 2/08* (2006.01)
(Continued)

(52) U.S. Cl.
CPC ..... *F04C 11/005* (2013.01); *F04C 2/084* (2013.01); *F04C 15/0057* (2013.01); *F04C 2/10* (2013.01); *F04C 2240/40* (2013.01)

(58) Field of Classification Search
CPC ..... F04C 2/084; F04C 2/10; F04C 15/0057; F04C 11/005–006; F04C 2240/40
See application file for complete search history.

(56) References Cited

U.S. PATENT DOCUMENTS 2,571,377 A * 10/1951 Olah ..... F04C 2/14 184/6.28
5,145,349 A * 9/1992 McBurnett ..... F04C 15/0042 418/206.5

(Continued)

FOREIGN PATENT DOCUMENTS

DE 102009021890 A1 * 12/2009 ..... F04C 11/008
DE 102011079822 A1 * 1/2013 ..... F04C 14/065

(Continued)

OTHER PUBLICATIONS

European Patent Office, International Search Report received in International Application No. PCT/DE22/100912, Mar. 14, 2023, 18 pages (including translation).

(Continued)

*Primary Examiner* — Alexander B Comley
(74) *Attorney, Agent, or Firm* — Suiter Swantz IP

(57) ABSTRACT

A tandem pump for an electric axle of a motor vehicle is described. The tandem pump includes a dry sump flow via which hydraulic fluid can be delivered from a transmission chamber into a hydraulic chamber. The tandem pump includes a main flow via which hydraulic fluid can be delivered from the hydraulic chamber to a hydraulic consumer. The dry sump flow and the main flow are formed by types of pumps having different inflow directions.

20 Claims, 2 Drawing Sheets

(51) Int. Cl.
*F04C 2/10* (2006.01)
*F04C 15/00* (2006.01)

(56) References Cited

U.S. PATENT DOCUMENTS

| | | | | |
|---|---|---|---|---|
| 12,270,396 | B2 * | 4/2025 | Rosinski | F04C 2/10 |
| 2006/0257267 | A1 * | 11/2006 | Weiss | F04C 2/18 417/199.1 |
| 2016/0281712 | A1 * | 9/2016 | Muizelaar | F04C 2/102 |
| 2017/0211572 | A1 * | 7/2017 | Jeong | F04C 15/008 |
| 2020/0208629 | A1 * | 7/2020 | Valkenberg | F04C 11/005 |

FOREIGN PATENT DOCUMENTS

| | | | | |
|---|---|---|---|---|
| DE | 102012212986 | A1 * | 2/2013 | F04C 2/10 |
| DE | 102016104416 | A1 * | 9/2017 | F04C 11/005 |
| DE | 202019107293 | U1 * | 3/2020 | F16H 57/0446 |
| DE | 102019201863 | B | 6/2020 | |
| DE | 102019201863 | B3 * | 6/2020 | F01M 1/02 |
| DE | 102021114710 | A1 * | 12/2022 | F04B 23/04 |
| EP | 2085616 | B1 * | 3/2017 | B64D 37/00 |
| JP | 2018062855 | A * | 4/2018 | F04C 2/101 |
| KR | 20150130551 | A * | 11/2015 | F04D 13/024 |
| KR | 20160041784 | A * | 4/2016 | F04C 2/18 |
| WO | WO-2011095148 | A2 * | 8/2011 | F04C 14/065 |
| WO | WO-2018169376 | A1 * | 9/2018 | F04D 13/12 |
| WO | WO-2022180496 | A1 * | 9/2022 | F04C 2/3446 |

OTHER PUBLICATIONS

German Patent Office, Office Action received in German Application No. 102022100574.7, Oct. 19, 2022, 12 pages (including translation).

* cited by examiner

TANDEM PUMP COMPRISING A MAIN FLOW AND A DRY SUMP FLOW

CROSS-REFERENCE TO RELATED APPLICATION

The present application is the U.S. National Phase of PCT Patent Application Number PCT/DE2022/100912, filed on Dec. 6, 2022, which claims priority to German Patent Application Number 10 2022 100 574.7 of, filed Jan. 12, 2022, the entire disclosures of which are incorporated by reference herein.

TECHNICAL FIELD

The disclosure relates to a tandem pump for an electric axle of a motor vehicle, comprising a dry sump flow via which hydraulic fluid can be conveyed from a transmission chamber into a hydraulic chamber, and a main flow via which hydraulic fluid can be conveyed from the hydraulic chamber to a hydraulic consumer.

BACKGROUND

Such tandem pumps are already known from the prior art, in which a dry sump functionality/dry sump flow is integrated in a pump for supplying hydraulic consumers.

However, the prior art always suffers the disadvantage that there are strict installation space requirements regarding the constructive design of the tandem pump, so that known tandem pumps do not fit into the available installation space in the axial or radial direction.

It is therefore the object of the disclosure to avoid or at least to mitigate the disadvantages of the prior art. In particular, a tandem pump is to be provided in which a dry sump functionality/dry sump flow is integrated in a pump for supplying hydraulic consumers and which simultaneously satisfies the installation space requirements. In addition, the dry sump flow of the tandem pump should be able to draw a certain amount of air without creating any acoustic abnormalities or allowing air from the dry sump side to reach the main flow side.

SUMMARY

The object is achieved by a tandem pump having the features of claim 1. Advantageous developments form the subject matter of the dependent claims.

Accordingly, the disclosure relates to a tandem pump for an electric axle of a motor vehicle, comprising a dry sump flow via which hydraulic fluid can be conveyed from a transmission chamber into a hydraulic chamber, and a main flow via which hydraulic fluid can be conveyed from the hydraulic chamber to a hydraulic consumer, wherein the dry sump flow and the main flow are formed by types of pumps having different inflow directions. This means that this object is achieved in a generic device, in particular according to the disclosure, by the fact that the dry sump flow and the main flow are formed by types of pumps having different inflow directions. In other words, the inventive solution consists of using two types of pumps, which can be used in their inflow direction in a manner optimized with regard to the use of installation space.

According to a preferred embodiment, the dry sump flow can be formed by a type of pump with an axial inflow direction and the main flow can be formed by a type of pump with a radial inflow direction. In particular, if these types of pumps are selected for the respective flow, the connections of the tandem pump can be arranged in such a way that the tandem pump fits into the given installation space. Alternatively, depending on the available installation space conditions, it can be advantageous if the dry sump flow is formed by a type of pump with a radial inflow direction and the main flow is formed by a type of pump with an axial inflow direction.

According to a preferred embodiment, the dry sump flow and the main flow can each have a separate inflow. Such a separate inflow is obligatory if two different reservoirs/tanks are to be drawn from. In this way, the dry sump flow can advantageously draw hydraulic fluid from the transmission chamber and the main flow can draw hydraulic fluid from the hydraulic chamber.

According to a preferred embodiment, the dry sump flow and the main flow can be formed by types of pumps having different form factors from each other. In particular, the choice of coaxial and axially parallel form factors for the two types of pumps makes it possible to implement an ideal arrangement of the hydraulic connections and screw connection points of the housing components of the tandem pump.

According to a preferred embodiment, the dry sump flow can be formed by a gerotor pump or an internal gear pump. Preferably, the dry sump flow can be formed by a gerotor pump due to installation-related advantages. A gerotor pump is a positive displacement pump. The gerotor pump has an inner rotor and an outer rotor. The inner rotor has n teeth (at least two teeth), while the outer rotor has n+1 teeth. One axis of the inner rotor is offset relative to the axis of the outer rotor, and both rotors rotate around their respective axes. This means that the driving and driven rotors are arranged eccentrically to one another. As gerotor pumps (or internal gear pumps) are designed to save radial installation space compared to external gear pumps, a radial enlargement of the tandem pump can thus be prevented. Another advantage of using a gerotor pump for the dry sump flow is that gerotor pumps are fully functional even with low levels of contamination and air entrainment, which is particularly important for the application conditions of a dry sump flow.

According to a preferred embodiment, the main flow can be formed by an external gear pump. An external gear pump is a positive displacement pump. The external gear pump has two identical gears that mesh with one another. One of the two gears is driven by a motor and the other of the two gears is driven by the driven gear. As external gear pumps are designed to save axial installation space compared to gerotor pumps (or internal gear pumps), an axial enlargement of the tandem pump can thus be prevented.

According to a preferred embodiment, the dry sump flow and the main flow can be mechanically coupled to one another, so that a defined ratio between the main flow and the dry sump flow is set. This means that the different displacement volumes can be used to set the defined ratio between the two flows in order to meet the requirements for the different demands on the respective flow. The mechanical coupling also makes it possible to simplify the driving of the tandem pump.

According to a preferred embodiment, the dry sump flow and the main flow can be driven via a common motor. This means that only one motor is required to drive the dry sump flow and the main flow, so that a particularly cost-effective and space-saving tandem pump can be provided. Alternatively, both the dry sump flow and the main flow can be driven by a separate motor.

According to a development of the preferred embodiment, the main flow can have a driving gear drivable by the motor and a driven gear drivable by the driving gear. According to the development of the preferred embodiment, the dry sump flow can have a rotor drivable by the driven gear of the main flow. This has the advantage that an axially parallel arrangement of the dry sump flow in relation to the driving gear and thus to the motor is made possible. At the same time, it is ensured that the main flow and the dry sump flow can be driven via the common motor.

According to a development of the preferred embodiment, the dry sump flow can be arranged axially parallel to the motor. This has the advantage that the connections (of the main flow) can be placed radially further inwards compared to a coaxial arrangement of the dry sump flow relative to the motor. This means that the main flow (with its connections) can be designed to be particularly compact.

According to a preferred embodiment, the tandem pump can have a radial shaft seal which separates the dry sump flow and the main flow from one another. This is an advantageous way of ensuring that there is no leakage between the two flows and that no air from the dry sump flow can get into the main flow.

In other words, the disclosure relates to a tandem pump having a dry sump flow. In general, double-flow pumps are already known in this regard, for example in the form of vane pumps, in which the inflow is implemented from a hydraulic reservoir, or in particular double-flow pumps are already known, in which a dry sump functionality/dry sump flow is integrated in the pump for supplying hydraulic consumers. In such a tandem pump, i.e., a pump with a dry sump flow and a main flow that draws from two reservoirs/tanks, the dry sump flow/dry sump pump is designed to draw from the transmission chamber and convey into a hydraulic chamber, while the main flow is designed to draw from the hydraulic chamber and supply the hydraulic consumers. In this context, due to the foaming of the oil in the transmission chamber, it is necessary for the dry sump flow to be able to draw a certain amount of air without producing any acoustic abnormalities. It is also necessary to prevent leakage between the two flows so that no air from the dry sump side reaches the main flow. Furthermore, the sealing between housing parts of the hydraulic pump should be particularly economical by utilizing the screw contact pressure, which requires the screws to be arranged at defined distances. The positioning of the screws is important in order to be able to seal the two flows simultaneously in tandem pumps.

According to the disclosure, two (different) types of pumps are used, which can be used in their inflow direction in a manner optimized with regard to the use of installation space. In particular, a combination of an external gear pump and a gerotor pump allows for a separate inflow of the flows or different inflow directions (radial/axial), which is required for drawing from different reservoirs, so that the pump connections can be positioned such that the pump fits into the given installation space. This means that the use of two types of pumps having different form factors ("coaxial" and "axially parallel") enables an ideal arrangement of the hydraulic connections and the screw connection points of the housings. In addition, these types of pumps are advantageous in terms of their low cost due to the price of their parts and their ease of industrialization. In contrast, a combination of two external gear pumps would lead to an increase in size radially, as the connections of the main flow would have to be moved radially outwards due to the axially parallel arrangement of an external gear pump serving as a dry sump flow. Furthermore, a combination of two gerotor pumps would lead to an increase in size axially, as an axial inflow is required and the installation space would have to be increased axially by the height of the inflow channel. An internal gear pump can also be used instead of the gerotor pump, wherein the gerotor pump is particularly advantageous in terms of its simple installation and is ideal for use as a dry sump pump, as it can cope with low levels of contamination and air entrainment. Preferably, the pump flows can be mechanically coupled as a tandem pump, so that the different displacement volumes can be used to set a defined ratio between the two flows in order to meet the requirements for the different demands on the main flow and dry sump flow. In addition, only one driving motor is required. For example, the gerotor pump can be driven by means of a coupling with the driven gear of the external gear pump, which allows the gerotor pump to be positioned axially parallel to the motor, which in turn allows the hydraulic connections of the external gear pump below to be arranged in the most compact way possible. In contrast to a coaxial arrangement of the gerotor pump relative to the motor, the connections can be placed radially further inwards in this way. Furthermore, a radial shaft seal can preferably be used between the flows, so that the ingress of air from the dry sump flow into the main flow is prevented.

BRIEF DESCRIPTION OF THE DRAWINGS

The disclosure is explained below with the aid of drawings. In the figures.

DETAILED DESCRIPTION

Figure 1:
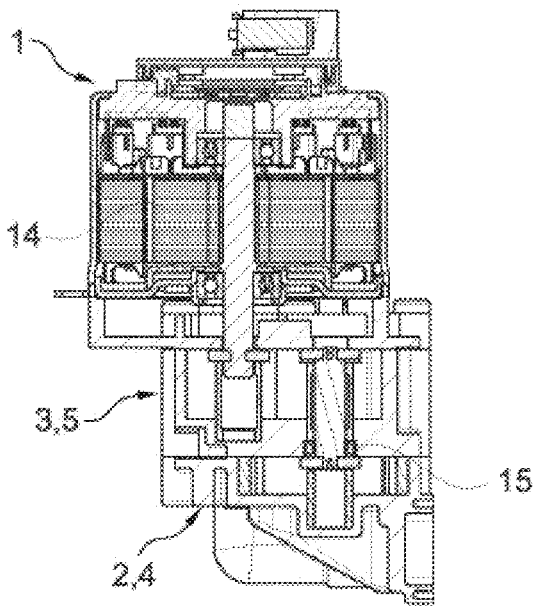
FIG. 1 shows a longitudinal sectional view of a tandem pump with a dry sump flow and a main flow.
Figure 2:
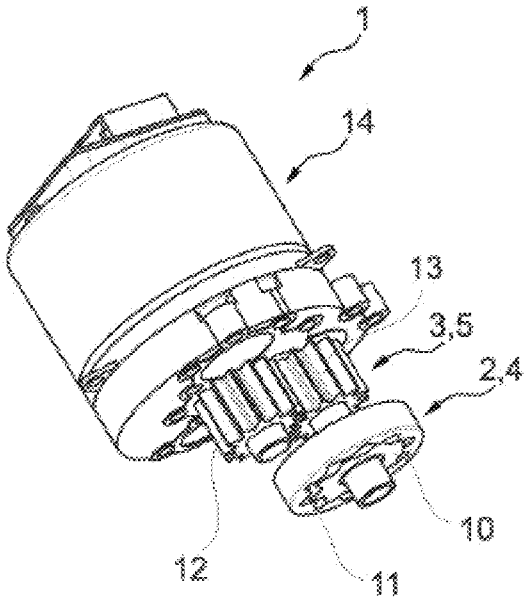
FIG. 2 shows a perspective view of the tandem pump, wherein a housing of the tandem pump is not shown.
Figure 3:
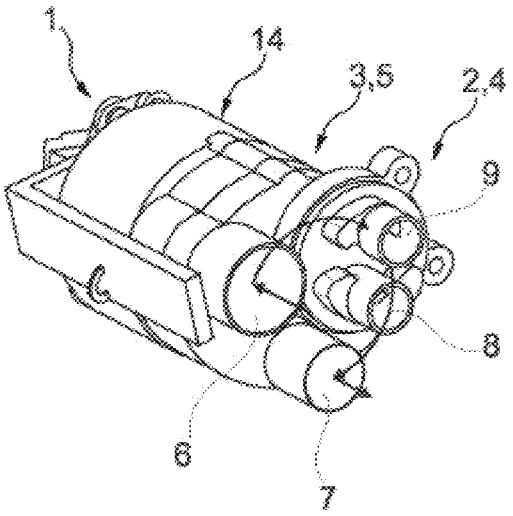
FIGS. 3 to 6 show perspective views of the tandem pump, in which an oil flow path of the dry sump flow and an oil flow path of the main flow as well as the installation space requirements of the tandem pump are illustrated.
Figure 4:
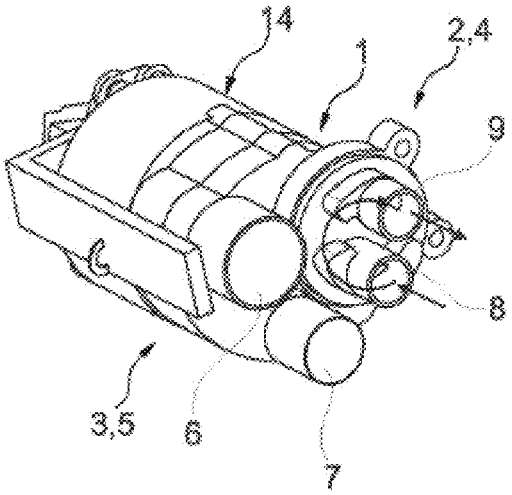

The figures are merely schematic in nature and serve solely for understanding the disclosure. Identical elements are provided with the same reference signs.

FIGS. 1 to 6 show an embodiment of a tandem pump 1 according to the disclosure. The tandem pump 1 is used in particular in an electric axle of a motor vehicle in order to supply one or more hydraulic consumers with hydraulic fluid. The tandem pump 1 has a dry sump flow 2 via which hydraulic fluid can be conveyed from a transmission chamber (not shown) into a hydraulic chamber (not shown). In addition, the tandem pump 1 has a main flow 3 via which hydraulic fluid can be conveyed from the hydraulic chamber (not shown) to the hydraulic consumer(s) (not shown).

According to the disclosure, the dry sump flow 2 and the main flow 3 are formed by types of pumps having different inflow directions. In particular, in the embodiment shown, the dry sump flow 2 is formed by a type of pump with an axial inflow direction, preferably by a gerotor pump 4, and the main flow 3 is formed by a type of pump with a radial inflow direction, preferably by an external gear pump 5.

In particular, the dry sump flow 2 and the main flow 3 can each have a separate inflow. As shown in particular in FIGS. 2 and 3, the main flow 3 has a suction-side connection 6 and a pressure-side connection 7, via which the hydraulic fluid can be fed into the main flow 3 or discharged from the main flow 3. The suction-side connection 6 can be connected or is connected to the hydraulic chamber and the pressure-side connection 7 can be connected or is connected to the hydraulic consumer(s). The drawn in hydraulic fluid is fed into the external gear pump 5 via the suction-side connection 6, conveyed by the external gear pump 5 and discharged via the pressure-side connection 7. As shown in particular in FIGS. 2 and 4, the dry sump flow 2 has a suction-side connection 8 and a pressure-side connection 9, via which the hydraulic fluid can be fed into the dry sump flow 2 or discharged from the dry sump flow 2. The suction-side connection 8 can be connected or is connected to the transmission chamber and the pressure-side connection 9 can be connected or is connected to the hydraulic chamber. The drawn in hydraulic fluid is fed into the gerotor pump 4 via the suction-side connection 8, conveyed by the gerotor pump 4 and discharged via the pressure-side connection 9.

The gerotor pump 4 is a positive displacement pump and has an inner rotor 10 and an outer rotor 11. The inner rotor 10 has n teeth (six teeth in this case), while the outer rotor 11 has n+1 teeth (seven teeth in this case). One axis of the inner rotor 10 is offset (in parallel) relative to the axis of the outer rotor 11, and both rotors 10, 11 rotate about their respective axes. This means that the driving and driven rotors 10, 11 are arranged eccentrically to one another.

The external gear pump 5 is a positive displacement pump and has two identical gears 12, 13 that mesh with one another. A first gear 12 of the two gears 12, 13 is driven by a motor 14 and a second gear 13 of the two gears 12, 13 is driven by the first (driven) gear 12. In the embodiment shown, the motor 14 is designed as an electric motor.

Preferably, the dry sump flow 2 and the main flow 3 are mechanically coupled to one another, so that a defined ratio between the main flow 3 and the dry sump flow 2 is set. In particular, the dry sump flow 2 and the main flow 3 can be driven via a common motor, in this case the motor 14. In particular, the driving rotor of the two rotors 10, 11 of the gerotor pump 4 is coupled to the second (driven) gear 13, so that the motor 14 drives the external gear pump 5 (or the first gear 12), and the external gear pump 5 (or the second gear 13) drives the gerotor pump 4.

Preferably, the dry sump flow 2 can be arranged axially parallel to the motor 14, i.e., to an axis of rotation of the motor 14.

In addition, the tandem pump 1 can have a radial shaft seal 15, which separates the dry sump flow 2 and the main flow 3 from one another. In the embodiment shown, the radial shaft seal 15 is arranged on an intermediate shaft between the second gear 13 of the external gear pump 5 and the rotor 10 of the gerotor pump 2.

Figure 5:
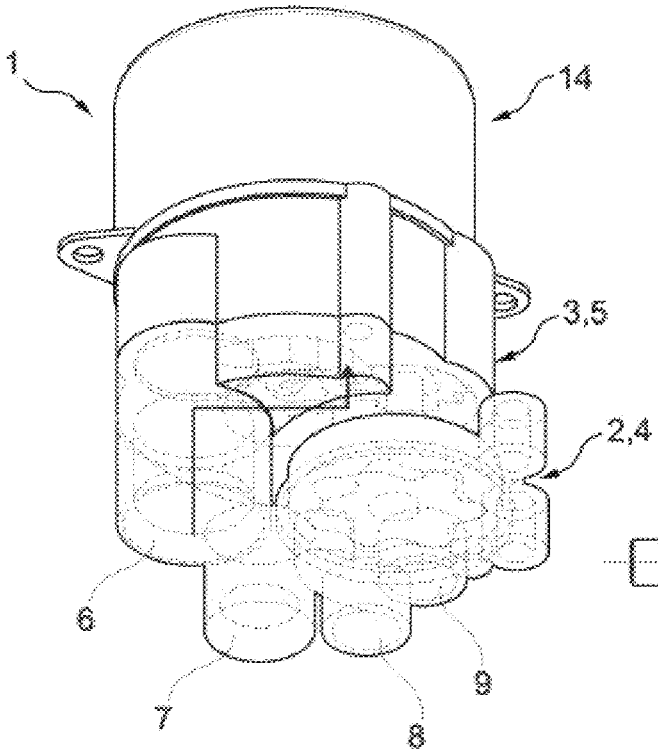
Figure 7:
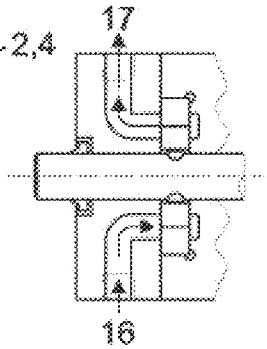
FIG. 7 shows a schematic sectional view of an arrangement of an inlet and an outlet.
Figure 6:
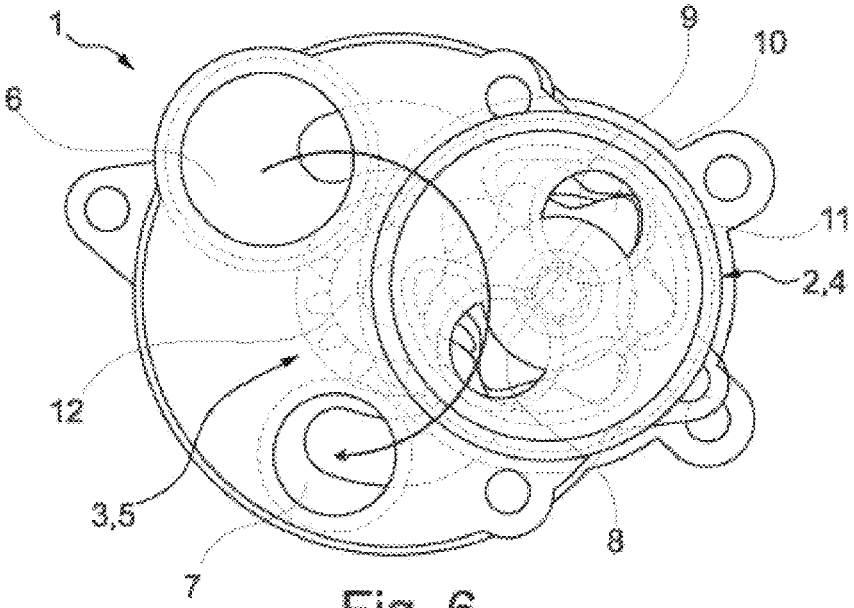

FIG. 5 in particular shows that the external gear pump 5 is at the top position and is designed with a radial inflow in order to minimize the axial installation space required. FIG. 6 in particular shows that the gerotor pump 4 is designed with an axial inflow in order to maintain radial installation space and avoid a collision (or displacement radially outwards) of the connections 6, 7 of the external gear pump 5. FIG. 7 schematically shows the necessary design of an inlet 16 and an outlet 17 of gerotor pumps in general. A radial inflow is inherently impossible with this type of pump.

LIST OF REFERENCE SIGNS

1 Tandem pump
2 Dry sump flow
3 Main flow
4 Gerotor pump
External gear pump
6 Suction-side connection
7 Pressure-side connection
8 Suction-side connection
9 Pressure-side connection
Inner rotor
11 Outer rotor
12 First gear
13 Second gear
14 Motor
Radial shaft seal
16 Inlet
17 Outlet

The invention claimed is:

1. A tandem pump for an electric axle of a motor vehicle, the tandem pump comprising:

a gerotor pump forming a dry sump flow conveying a hydraulic fluid from a transmission chamber into a hydraulic chamber, the gerotor pump comprising an inner rotor and an outer rotor;

an external gear pump forming a main flow conveying the hydraulic fluid from the hydraulic chamber to a hydraulic consumer, the gerotor pump and the external gear pump having different inflow directions, the external gear pump comprising a driving gear and a driven gear; and a motor driving the dry sump flow and the main flow by the motor driving the driving gear, the driving gear driving the driven gear, and the driven gear driving the inner rotor, the inner rotor is axially offset from and driven via a coupling with the driven gear.

2. The tandem pump according to claim 1, wherein the gerotor pump comprises an axial inflow direction and the external gear pump comprises a radial inflow direction.

3. The tandem pump according to claim 1, wherein the dry sump flow and the main flow each have a separate inflow.

4. The tandem pump according to claim 1, wherein the gerotor pump and the external gear pump have different form factors.

5. The tandem pump according to claim 1, wherein the driven gear and the inner rotor are affixed to a common shaft.

6. The tandem pump according to claim 1, wherein the dry sump flow and the main flow are mechanically coupled to one another, so that a defined ratio between the main flow and the dry sump flow is set.

7. The tandem pump according to claim 1, wherein an axis of the outer rotor is offset from an axis of the inner rotor and the driven gear.

8. The tandem pump according to claim 1, wherein the driven gear meshes with the driving gear.

9. The tandem pump according to claim 1, wherein the dry sump flow is arranged axially parallel to the motor.

10. The tandem pump according to claim 1, wherein the tandem pump has a radial shaft seal which separates the dry sump flow and the main flow from one another.

11. A tandem pump for an electric axle of a motor vehicle, the tandem pump comprising:

a gerotor pump forming a dry sump flow via which a hydraulic fluid is conveyed from a transmission chamber into a hydraulic chamber, the gerotor pump comprising an inner rotor and an outer rotor;

an external gear pump forming a main flow via which the hydraulic fluid is conveyed from the hydraulic chamber to a hydraulic consumer, the dry sump flow is mechanically coupled to the main flow, the gerotor pump and the external gear pump having different inflow directions, the external gear pump comprising a driving gear and a driven gear, there is no leakage between the dry sump flow and the main flow, air from the dry sump flow is sealed from the main flow; and a motor driving the dry sump flow and the main flow by the motor driving the driving gear, the driving gear driving the driven gear, and the driven gear driving the inner rotor, the inner rotor is axially offset from and driven via a coupling with the driven gear.

12. The tandem pump according to claim 11, wherein the gerotor pump comprises an axial inflow direction and the external gear pump comprises a radial inflow direction.

13. The tandem pump according to claim 11, wherein the dry sump flow and the main flow each have a separate inflow.

14. The tandem pump according to claim 11, wherein the gerotor pump and the external gear pump have different form factors.

15. The tandem pump according to claim 11, wherein the driven gear and the inner rotor are affixed to a common shaft.

16. The tandem pump according to claim 11, wherein an axis of the outer rotor is offset from an axis of the inner rotor and the driven gear.

17. The tandem pump according to claim 11, wherein the driven gear meshes with the driving gear.

18. The tandem pump according to claim 11, wherein the dry sump flow is arranged axially parallel to the motor.

19. The tandem pump according to claim 11, wherein the tandem pump includes a radial shaft seal separating the dry sump flow and the main flow.

20. A motor vehicle comprising:

an electric axle comprising a tandem pump supplying one or more hydraulic consumers with hydraulic fluid, the tandem pump comprises:

a gerotor pump forming a dry sump flow conveying a hydraulic fluid from a transmission chamber into a hydraulic chamber, the gerotor pump comprising an inner rotor and an outer rotor;

an external gear pump forming a main flow conveying the hydraulic fluid from the hydraulic chamber to the one or more hydraulic consumers, the dry sump flow is mechanically coupled to the main flow, the gerotor pump and the external gear pump having different inflow directions, the external gear pump comprising a driving gear and a driven gear; and a motor driving the dry sump flow and the main flow by the motor driving the driving gear, the driving gear driving the driven gear, and the driven gear driving the inner rotor, the inner rotor is axially offset from and driven via a coupling with the driven gear.

* * * * *